US012311219B2

(12) United States Patent
Bartolomei

(10) Patent No.: US 12,311,219 B2
(45) Date of Patent: May 27, 2025

(54) BARBELL ATTACHMENT SYSTEM

(71) Applicant: Brian Bartolomei, Vista, CA (US)

(72) Inventor: Brian Bartolomei, Vista, CA (US)

( * ) Notice: Subject to any disclaimer, the term of this patent is extended or adjusted under 35 U.S.C. 154(b) by 138 days.

(21) Appl. No.: 18/327,425

(22) Filed: Jun. 1, 2023

(65) Prior Publication Data

US 2024/0399192 A1 Dec. 5, 2024

(51) Int. Cl.
*A63B 21/08* (2006.01)
*A63B 21/00* (2006.01)
*A63B 21/072* (2006.01)

(52) U.S. Cl.
CPC ..... *A63B 21/08* (2013.01); *A63B 21/0724* (2013.01); *A63B 21/4049* (2015.10)

(58) Field of Classification Search
CPC ... A63B 21/072; A63B 21/0724; A63B 21/08; A63B 21/4049
See application file for complete search history.

(56) References Cited

U.S. PATENT DOCUMENTS 4,252,316 A 2/1981 Price
5,207,624 A * 5/1993 Paskovich ..... A63B 21/072 482/109
5,244,444 A * 9/1993 Wostry ..... A63B 21/4047 482/109
8,974,354 B1 * 3/2015 Nelson ..... A63B 21/08 482/94
9,289,646 B2 * 3/2016 Tully ..... A63B 23/03525
9,636,538 B2 * 5/2017 DiPasquale ..... A63B 21/075
9,808,663 B2 11/2017 Chen
9,821,186 B2 * 11/2017 Chen ..... A63B 23/1209
11,130,013 B2 9/2021 Tabone
11,478,674 B1 10/2022 Kuka
11,648,452 B1 * 5/2023 Zhang ..... A63B 21/0724 482/106
12,161,905 B2 * 12/2024 Tellam ..... A63B 21/08
2014/0073492 A1 * 3/2014 Hunter ..... A63B 21/0615 482/98
2016/0008653 A1 * 1/2016 Dipasquale ..... A63B 21/0728 482/139
2019/0275365 A1 9/2019 Bongelli

* cited by examiner

*Primary Examiner* — Joshua Lee
(74) *Attorney, Agent, or Firm* — Foley & Lardner LLP

(57) ABSTRACT

A barbell attachment system includes an attachment member having a first end, a second end, and a cylindrical portion extending between the first end and the second end, wherein the attachment member is configured to be releasably coupled to a substantially cylindrical element. The barbell attachment system further includes a barbell having a pair of collars and a gripping portion extending between the pair of collars. The barbell attachment system further includes a pair of support members, wherein each respective support member extends between one of the pair of collars and a portion of the attachment member. The barbell attachment system further includes wherein the pair of support members, the gripping portion, and the attachment member collectively define a lifting zone.

20 Claims, 2 Drawing Sheets

BARBELL ATTACHMENT SYSTEM

BACKGROUND

A popular exercise machine called the "Landmine" or "T-bar" machine, is a piece of gym equipment used to target and strengthen various muscles, including the back, shoulders, and legs. The machine consists of a barbell that is attached to a pivot point at one end and is free at the opposite end, allowing the user to perform various exercises by lifting and moving the free end of the bar in different directions. Common exercises that can be performed with a landmine machine include, for example, landmine rows, landmine presses, landmine squats, and various rotational exercises. These exercises can help to improve a user's overall strength, stability, and athleticism.

Various accessories can be attached to the free end of the barbell or coupling mechanism of the landmine machine that allow a user to perform a larger number of exercises with the landmine machine. However, the landmine machine is not suited to performing Olympic style lifts such as the snatch or the clean and jerk. The snatch is a lift in which the athlete lifts a barbell from the ground to overhead in one continuous motion. The athlete starts in a squat position with the barbell on the ground, then explosively lifts the bar upwards and the athlete then drops under the bar, catching it in a squat position with the arms fully extended overhead. The clean and jerk is a two-part lift in which the athlete first lifts the barbell from the ground to the shoulders (the "clean") and then lifts it overhead (the "jerk"). The clean involves lifting the bar from the ground to the shoulders using a similar technique to the snatch. Once the bar is at the shoulders, the athlete stands up and prepares for the jerk. In the jerk, the athlete explosively pushes the bar overhead while simultaneously dropping under the bar and catching it with straight arms overhead. Both lifts requires a combination of explosive power, strength, technique, speed, coordination, balance, and flexibility. Thus, a need exists for an attachment to the landmine machine that allows for users to practice the fundamentals of, and build expertise with Olympic style lifts.

Moreover, most landmine machines require that the weight be added to the end of the barbell of the landmine machine. This places the weight in front of the user and does not accurately mimic many free weight lifts where the weight will be placed in line with the user's hips as opposed to in front of the user. Thus, a need exists for an attachment to the landmine machine that allows for users to position the weight closer to in line with the user's hips as opposed to in front of the user.

SUMMARY OF THE INVENTION

According to a first aspect, an exercise bar attachment apparatus includes an attachment member having a first end, a second end, and a cylindrical portion extending between the first end and the second end. The exercise bar attachment apparatus further includes a barbell having a gripping portion. The exercise bar attachment apparatus further includes a pair of support arms extending between the attachment member and the barbell.

According to many embodiments, the cylindrical portion further includes a through hole configured to receive a stop member.

In some embodiments, the pair of support arms and gripping portion collectively define an inner lifting zone.

According to other embodiments, each of the pair of support arms includes a perpendicular portion coupled to the barbell and an angled portion coupled to the attachment member.

In many embodiments, the gripping portion is configured to rotate.

According to yet another embodiment, the first end of the attachment member is closed.

According to a second aspect, an exercise rack attachment system includes an attachment member having a substantially circular first end, a substantially circular a second end, and a cylindrical portion extending between the first end and the second end, wherein the attachment member is configured to be releaseably secured to a substantially cylindrical element. The exercise rack attachment system further includes a barbell having a first collar, a second collar, and a gripping portion extending between the first collar and the second collar. The exercise rack attachment system further includes a first connection member having a first perpendicular portion and a first angled portion, where the first perpendicular portion is coupled to the first collar and the first angled portion is coupled to a portion of the attachment member. The exercise rack attachment system further includes a second connection member having a second perpendicular portion and a second angled portion, where the second perpendicular portion is coupled to the second collar and the second angled portion is coupled to a portion of the attachment member.

According to some embodiments, the cylindrical portion further includes a through hole configured to receive a stop member.

In many embodiments, the first connection member, the second connection member, and the gripping portion collectively define an inner lifting zone.

According to other embodiments, the first angled portion intersects the attachment member at a 90 degree angle.

According to some embodiments, the second angled portion intersects the attachment member at a 90 degree angle.

In other embodiments, the gripping portion is configured to rotate.

According to yet another embodiment, the second end of the attachment member is closed.

According to a third aspect, a barbell attachment system includes an attachment member having a first end, a second end, and a cylindrical portion extending between the first end and the second end, wherein the attachment member is configured to be releasably coupled attached to a substantially cylindrical element. The barbell attachment system further includes a barbell having a pair of collars and a gripping portion extending between the pair of collars. barbell attachment system further includes a pair of support members, wherein each respective support member extends between one of the pair of collars and a portion of the attachment member. barbell attachment system further includes wherein the pair of support members, the gripping portion, and the attachment member collectively define a lifting zone.

According to some embodiments, the cylindrical portion further comprises a through hole configured to receive a stop member.

In many embodiments, each support member includes a perpendicular portion and an angled portion.

According to other embodiments, the perpendicular portion of each support member is coupled to a portion of the barbell and the angled portion of each support member is coupled to the attachment member.

In some embodiments, the support members have a curvilinear shape.

According to many embodiments, the gripping portion is configured to rotate.

In yet another embodiment, the first end of the attachment member is closed.

BRIEF DESCRIPTION OF THE DRAWINGS

The disclosure will become more fully understood from the following detailed description, taken in conjunction with the accompanying figures, wherein like reference numerals refer to like elements, in which.

The drawings are not necessarily to scale and certain features may be shown exaggerated in scale or in somewhat schematic form in the interest of clarity and conciseness.

DETAILED DESCRIPTION

Figure 1:
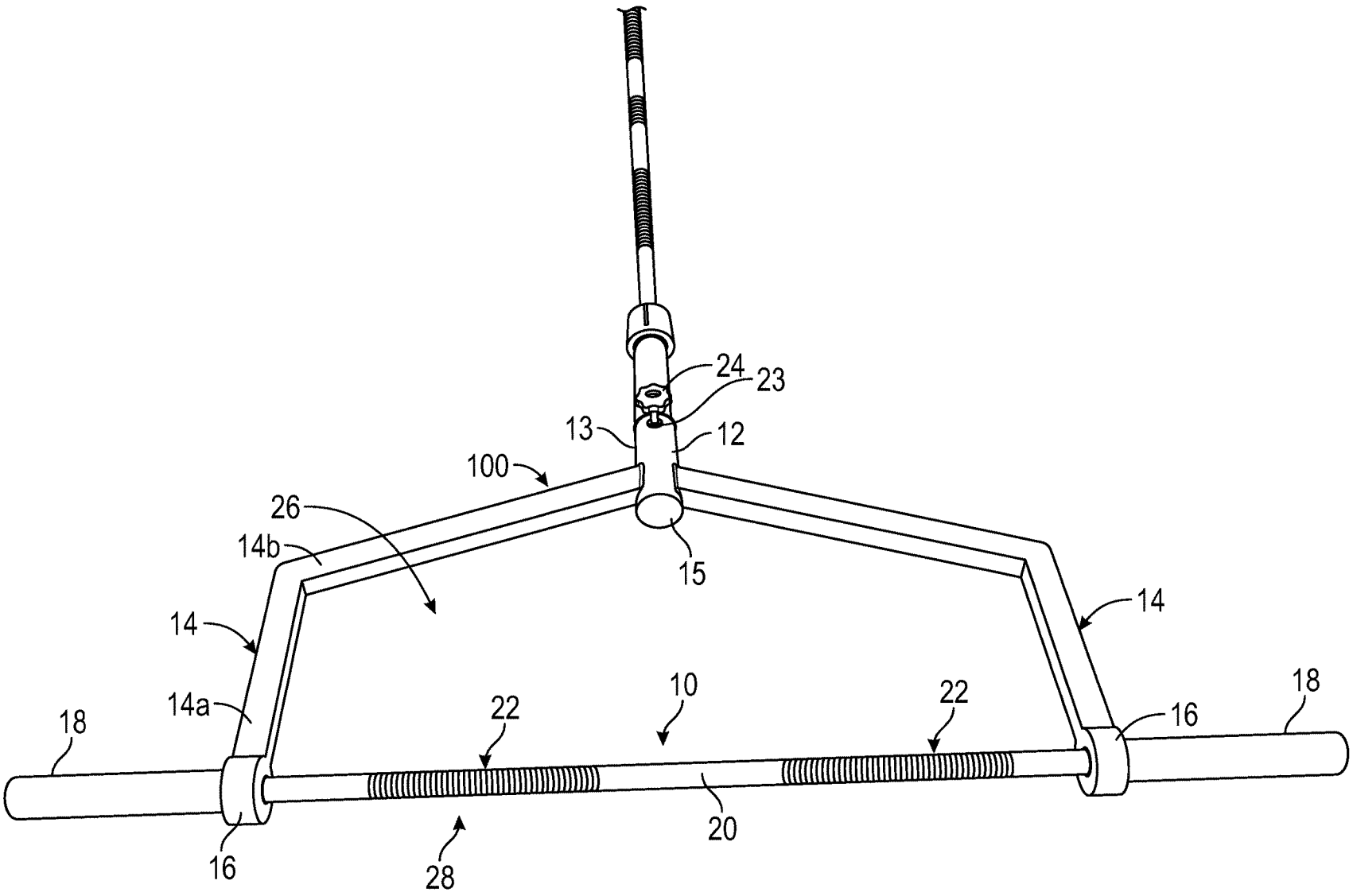
FIG. 1 is a top perspective view of an embodiment of a barbell attachment system.

Reference is now made to FIG. 1 which depicts an embodiment of a barbell attachment system 100. The barbell attachment system 100 is configured to be releasably connected to, coupled to, secured to, or otherwise interfaced with the free barbell end of a landmine exercise machine 200 or an end of a barbell. In this manner, the barbell attachment system 100 facilitates the ability for a user to practice Olympic style lifts such as the clean and jerk and the snatch, as well as other lifts utilizing a barbell. The barbell attachment system 100 includes a barbell 10, an attachment member 12, and a pair of support members 14.

With continued reference to FIG. 1, a barbell 10 includes a pair of collars 16, a pair of sleeves 18, and a gripping portion 20. The sleeve 18 is the rotating cylindrical section of the barbell 10 that extends beyond the collar 16 and onto which weight plates are loaded. The sleeve 18 is designed to spin freely about the barbell 10, which allows the weight plates to rotate with the user's movements during lifts like the clean and jerk and snatch. According to other embodiments, the sleeves 18 have grooves, indentions, or other features to minimize lateral movement of the weight plates along the sleeves 18 during use. The collar 16 is the portion of the sleeve 18 that is closest to the center of the barbell 10. The collar 16 creates a ledge for the weight plates to abut to as they are slid onto the sleeve 18. The gripping portion 20 extends between the pair of collars 16 and is the portion of the barbell 10 that a user grasps with their hands during a lift. According to some embodiments, the gripping portion 20 includes knurled portions 22 or a cross-hatch pattern to provide a better grip for the user. The user's hands are usually positioned on the gripping portion 20 at a specific distance apart, depending on the type of lift being performed, and the knurled portions 22 can help them maintain a secure grip on the barbell 10 during the lift.

With continued reference to FIG. 1, the attachment member 12 is configured to releaseably couple, secure, interface, connect, or otherwise secure the barbell attachment system 100 to the landmine barbell end or other coupling mechanism of the landmine exercise machine 200. The attachment member 12 is generally cylindrical in shape and has a first end 13 and an opposed second end 15. The first end 13 is open to accept or receive the barbell end or coupling mechanism of the landmine machine 200. The second end 15 is closed to prevent the barbell end or coupling mechanism of the landmine machine 200 from protruding into the inner lifting zone 26. Both ends 13, 15 are generally circular in shape, but can be any suitable shape that allows or facilitates the attachment member 12 to couple to or interface with the landmine machine 200. According to some embodiments, the second end 15 is open or unobstructed. In many embodiments, the attachment member 12 includes a through hole 23 configured to receive a stop member 24. A portion of the stop member 24 is configured to be inserted through the through hole 23 once the attachment member 12 has received the free barbell end of the landmine machine 200 and impinge upon the free barbell end to prevent the attachment member 12 from coming off of the free end of the barbell unexpectedly. The stop member 24 may be utilized in embodiments where the second end 15 is open or unobstructed to set the depth of the free end of the barbell of the landmine machine 200 to not protrude into the inner lifting zone 26. The stop member 24 may be utilized with embodiments where the second end 15 is closed as a safety measure to help ensure that the attachment member 12 remains coupled to the free end of the barbell of the landmine machine 200 during a lift.

The support members 14 connect the barbell 10 to the attachment member 12. The support members 14 are shaped and sized such that a user may position their body within the lifting zone 26, initiate, and complete a lift from within the inner lifting zone 26. In many embodiments, the support members 14 are formed of a perpendicular portion 14*a* and an angled portion 14*b*. The perpendicular portion 14*a* connects or couples to the collar 16 and extends perpendicularly out from the collar 16. The angled portion 14*b* connects or couples to the attachment member 12 and extends out from the attachment member 12 to connect to the terminal end of the perpendicular portion 14*a* at an angle. It should be understood that while the angled portion 14*b* is depicted as the only portion of the support members that intersect either the attachment member 12 or the collar 16 at a non-perpendicular angle, alternate configurations may be used. For example, according to some embodiments, both portions 14*a*, 14*b*, of the support member 14 are angled with respect to the attachment member 12 and the collar 16 respectively. In other embodiments, the support member 14 is formed of a curvilinear shape, such that each support member 14 forms a smooth arc that extends between the attachment member 12 and the collar 16. The support members 14 can be formed of any shape such that the inner lifting zone 26 is sized such that a user may position their body within the lifting zone 26, initiate, and complete a lift from within the inner lifting zone 26.

The barbell attachment system 100 includes an inner lifting zone 26 and an outer lifting zone 28. The inner lifting zone is the area defined collectively by the barbell 10, the support members 14, and the attachment member 12. The inner lifting zone 26 is sized such that a user may position their body within the lifting zone 26, initiate, and complete a lift from within the inner lifting zone 26. While in the inner lifting zone 26, the user's back will be facing the attachment member 12. The outer lifting zone 28 is the area directly opposite of the inner lifting zone with respect to the barbell 10, such that the user's face is facing the attachment member 12. Either lifting zone 26, 28 may be utilized by users for various types or kinds of lifts. In either lifting zone 26, 28, the weight that the user is lifting is substantially aligned with the user's hips. Stated differently, the weight that the user is lifting with the barbell attachment system 100 is positioned in a substantially similar position to where the weight would be if the user was executing the same lift with a standard barbell that was not attached to any device or mechanism. This weight placement allows for users to experience a more realistic feel for how a free weight barbell will feel and react during different phases of a lift within the relative safety of a landmine exercise machine 200. Such realistic training aids users in their eventual transition from lifts using machines such as the landmine exercise machine 200 to free weight lifts.

To utilize the barbell attachment system 100, a user would first couple the barbell attachment system 100 to the barbell end or coupling mechanism of the landmine exercise machine 200 or an end of a separate barbell. Then the user would place equal amounts of weight on both sleeves 18 of barbell 10. Then the user would position themselves either in the outer lifting zone 28 or the inner lifting zone 26. Then the user would grip the gripping portion 20 of the barbell 10 and initiate their lift.

Figure 2:
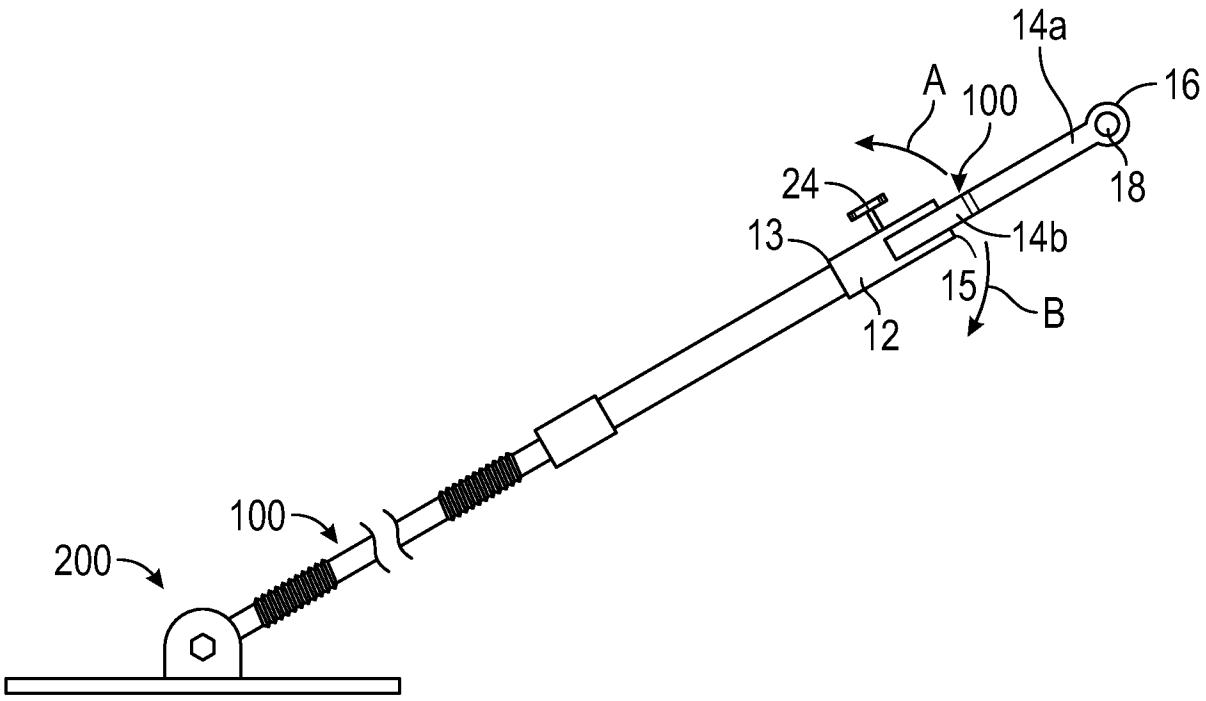
FIG. 2 is a side plan view of an embodiment of a barbell attachment system.

Referring now to FIG. 2, which depicts a side plan view of the barbell attachment system 100 coupled to a landmine exercise machine 200. In use, the barbell attachment system can be moved by the user along arcs A or B during their lift. Moreover, in some embodiments, the landmine mechanism 200 is secured to the ground by bolts, studs and nuts, fasteners, or any other type of ground securing mechanism that is suitable to keep the landmine mechanism 200 stable during a user's lift. In other embodiments, the landmine mechanism 200 is configured to be pressed into a corner of a room such that the landmine mechanism 200 is held in place by abutting walls on either side of the landmine mechanism 200.

In some aspects, the techniques described herein relate to an exercise bar attachment apparatus, the apparatus including: an attachment member having a first end, a second end, and a cylindrical portion extending between the first end and the second end; a barbell having a gripping portion; and a pair of support arms extending between the attachment member and the barbell.

In some aspects, the techniques described herein relate to a barbell attachment system, wherein the first end of the attachment member is closed.

In some aspects, the techniques described herein relate to an exercise bar attachment apparatus, wherein the cylindrical portion further includes a through hole configured to receive a stop member.

In some aspects, the techniques described herein relate to an exercise bar attachment apparatus, wherein the pair of support arms and gripping portion collectively define an inner lifting zone.

In some aspects, the techniques described herein relate to an exercise bar attachment apparatus, wherein each of the pair of support arms includes a perpendicular portion coupled to the barbell and an angled portion coupled to the attachment member.

In some aspects, the techniques described herein relate to an exercise bar attachment apparatus, wherein the gripping portion is configured to rotate.

In some aspects, the techniques described herein relate to an exercise bar attachment apparatus, wherein the first end of the attachment member is closed.

In some aspects, the techniques described herein relate to an exercise rack attachment system, the system including: an attachment member having a substantially circular first end, a substantially circular a second end, and a cylindrical portion extending between the circular first end and the second end, wherein the attachment member is configured to be releaseably secured to a substantially cylindrical element; a barbell having a first collar, a second collar, and a gripping portion extending between the first collar and the second collar; a first connection member having a first perpendicular portion and a first angled portion, where the first perpendicular portion is coupled to the first collar and the first angled portion is coupled to a portion of the attachment member; and a second connection member having a second perpendicular portion and a second angled portion, where the second perpendicular portion is coupled to the second collar and the second angled portion is coupled to a portion of the attachment member.

In some aspects, the techniques described herein relate to an exercise rack attachment system, wherein the cylindrical portion further includes a through hole configured to receive a stop member.

In some aspects, the techniques described herein relate to an exercise rack attachment system, wherein the first connection member, the second connection member, and the gripping portion collectively define an inner lifting zone.

In some aspects, the techniques described herein relate to an exercise rack attachment system, wherein the first angled portion intersects the attachment member at a 90 degree angle.

In some aspects, the techniques described herein relate to an exercise rack attachment system, wherein the second angled portion intersects the attachment member at a 90 degree angle.

In some aspects, the techniques described herein relate to an exercise rack attachment system, wherein the gripping portion is configured to rotate.

In some aspects, the techniques described herein relate to an exercise rack attachment system, wherein the second end of the attachment member is closed.

In some aspects, the techniques described herein relate to a barbell attachment system, the system including: an attachment member having a first end, a second end, and a cylindrical portion extending between the first end and the second end, wherein the attachment member is configured to be releasably coupled to a substantially cylindrical element; a barbell having a pair of collars and a gripping portion extending between the pair of collars; a pair of support members, wherein each respective support member extends between one of the pair of collars and a portion of the attachment member; wherein the pair of support members, the gripping portion, and the attachment member collectively define a lifting zone.

In some aspects, the techniques described herein relate to a barbell attachment system, wherein the cylindrical portion further includes a through hole configured to receive a stop member.

In some aspects, the techniques described herein relate to a barbell attachment system, wherein each support member includes a perpendicular portion and an angled portion.

In some aspects, the techniques described herein relate to a barbell attachment system, wherein the perpendicular portion of each support member is coupled to a portion of the barbell and the angled portion of each support member is coupled to the attachment member.

In some aspects, the techniques described herein relate to a barbell attachment system, wherein the support members have a curvilinear shape.

In some aspects, the techniques described herein relate to a barbell attachment system, wherein the gripping portion is configured to rotate.

As used herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the figures. It should be noted that the orientation of various elements may differ according to other exemplary embodiments, and that such variations are intended to be encompassed by the present disclosure.

Although the figures and description may illustrate a specific order of method steps, the order of such steps may differ from what is described, unless specified differently above. Also, two or more steps may be performed concurrently or with partial concurrence, unless specified differently above. All such variations are within the scope of the disclosure.

It is important to note that the construction and arrangement of the assemblies as shown in the various exemplary embodiments is illustrative only. Additionally, any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. An exercise bar attachment apparatus releasably coupleable to a landmine exercise machine, the apparatus comprising:

an attachment member having a first end, a second end, and a cylindrical portion extending along a central axis between the first end and the second end, the second end configured to be secured to a portion of the landmine exercise machine;

a barbell having a gripping portion; and a pair of support arms extending between the attachment member and the barbell and configured to secure the barbell to the attachment member in a position that is perpendicular to the central axis of the attachment member.

2. The exercise bar attachment apparatus of claim 1, wherein the cylindrical portion further includes a through hole configured to receive a stop member.

3. The exercise bar attachment apparatus of claim 1, wherein the pair of support arms and gripping portion collectively define an inner lifting zone.

4. The exercise bar attachment apparatus of claim 1, wherein each of the pair of support arms includes a perpendicular portion coupled to the barbell and an angled portion coupled to the attachment member.

5. The exercise bar attachment apparatus of claim 1, wherein the gripping portion is configured to rotate.

6. The exercise bar attachment apparatus of claim 1, wherein the first end of the attachment member is closed.

7. An exercise rack attachment system releasably coupleable to a landmine exercise machine, the attachment system comprising:

an attachment member having a substantially circular first end, a substantially circular a second end, and a cylindrical portion extending along a central axis between the circular first end and the second end, wherein the first end of the attachment member is configured to be releaseably secured to a substantially cylindrical element and the second end is configured to be secured to a portion of the landmine exercise machine;

a barbell having a first collar, a second collar, and a gripping portion extending between the first collar and the second collar;

a first connection member having a first perpendicular portion and a first angled portion, where the first perpendicular portion is directly coupled to the first collar and the first angled portion is coupled to a portion of the attachment member; and a second connection member having a second perpendicular portion and a second angled portion, where the second perpendicular portion is directly coupled to the second collar and the second angled portion is coupled to a portion of the attachment member;

wherein the first connection member and the second connection member are configured to secure the barbell to the attachment member in a position that is perpendicular to the central axis of the attachment member.

8. The exercise rack attachment system of claim 7, wherein the cylindrical portion further comprises a through hole configured to receive a stop member.

9. The exercise rack attachment system of claim 7, wherein the first connection member, the second connection member, and the gripping portion collectively define an inner lifting zone.

10. The exercise rack attachment system of claim 7, wherein the first angled portion intersects the attachment member at a 90 degree angle.

11. The exercise rack attachment system of claim 10, wherein the second angled portion intersects the attachment member at a 90 degree angle.

12. The exercise rack attachment system of claim 7, wherein the gripping portion is configured to rotate.

13. The exercise rack attachment system of claim 7, wherein the second end of the attachment member is closed.

14. A barbell attachment system releasably coupleable to a landmine exercise machine, the attachment system comprising:

an attachment member having a first end, a second end, and a cylindrical portion extending along a central axis between the first end and the second end, wherein the first end of the attachment member is configured to be releasably coupled to a substantially cylindrical element and the second end is configured to be secured to a portion of the landmine exercise machine;

a barbell having a pair of collars and a gripping portion extending between the pair of collars;

a pair of support members, wherein each respective support member is directly coupled to one of the pair of collars and extends between one of the pair of collars and a portion of the attachment member, wherein the pair of support members are configured to secure the barbell to the attachment member in a position that is perpendicular to the central axis of the attachment member;

wherein the pair of support members, the gripping portion, and the attachment member collectively define a lifting zone.

15. The barbell attachment system of claim 14, wherein the cylindrical portion further comprises a through hole configured to receive a stop member.

16. The barbell attachment system of claim 14, wherein each support member includes a perpendicular portion and an angled portion.

17. The barbell attachment system of claim 16, wherein the perpendicular portion of each support member is coupled to a portion of the barbell and the angled portion of each support member is coupled to the attachment member.

18. The barbell attachment system of claim 14, wherein the support members have a curvilinear shape.

19. The barbell attachment system of claim 14, wherein the gripping portion is configured to rotate.

20. The barbell attachment system of claim 14, wherein the first end of the attachment member is closed.

* * * * *